US005848512A

United States Patent [19]

Conn

[11] Patent Number: 5,848,512

[45] Date of Patent: Dec. 15, 1998

[54] STRUCTURAL MEMBER FOR WALL ASSEMBLY

[76] Inventor: Douglas R. Conn, 5458 SW. Anhinga Ave., Palm City, Fla. 34990

[21] Appl. No.: 897,245

[22] Filed: Jul. 18, 1997

[51] Int. Cl.[6] ..... E04C 3/36

[52] U.S. Cl. ..... 52/729.1; 52/731.9; 52/733.2; 52/220.1; 52/506.05; 52/508; 52/481.1

[58] Field of Search ..... 52/733.2, 731.9, 52/729.1, 508, 506.06, 506.05, 506.01, 481.1, 489.2, 483.1, 461, 220.1

[56] References Cited

U.S. PATENT DOCUMENTS

| | | | |
|---|---|---|---|
| 754,270 | 3/1904 | Wittekind | 52/733.2 X |
| 1,843,384 | 2/1932 | Done . | |
| 1,880,453 | 10/1932 | Kantzler | 52/481.1 X |
| 1,900,541 | 3/1933 | Buelow et al. | 52/481.1 X |
| 1,959,135 | 5/1934 | Miller | 52/733.2 X |
| 2,225,574 | 12/1940 | Thomson | 52/506.05 X |
| 3,066,774 | 12/1962 | Dahme | 52/731.9 X |
| 3,083,794 | 4/1963 | Stovall | 52/731.9 X |
| 3,394,507 | 7/1968 | Doke | 52/729.1 X |
| 4,793,113 | 12/1988 | Bodnar | 52/733.2 X |
| 5,414,971 | 5/1995 | Handte | 52/506.06 |
| 5,579,621 | 12/1996 | Fang | 52/483.1 |
| 5,664,380 | 9/1997 | Hsueh | 52/731.9 X |

*Primary Examiner*—Robert Canfield
*Attorney, Agent, or Firm*—McHale & Slavin, P.A

[57] ABSTRACT

A structural member for use in securing a wallboard to an existing wall. The structural member is constructed a single piece of extruded plastic formed into an I-beam shape with a hollow center. The hollow center eases passage of a fastener mechanism, yet provides structural rigidity with the reinforcement by the fastener. Passage of water pipes and electrical wires transversely is possible by use of predefined spacer wall openings.

6 Claims, 2 Drawing Sheets

STRUCTURAL MEMBER FOR WALL ASSEMBLY

FIELD OF THE INVENTION

This invention relates to wall assembly and, more particularly, to a structural member for securely positioning a finishing wall to a support wall.

BACKGROUND OF THE INVENTION

Conventional wall assembly consists of a finishing wall placed over a support wall. For instance, a home constructed of brick requires a finishing wall due to the inherent unevenness and rather unsightly appearance of the brick support wall used in the framing of the home. Another example is basement construction wherein the walls are typically formed from poured concrete. The concrete provides an interior surface that is not conducive to wallpaper or hanging pictures. Remodeling of older homes presents yet another example of the need for finishing walls due to the propensity of plaster cracking.

For these reasons, finishing walls are placed over the support walls providing a decorative interior. The finishing wall is typically spaced a relatively short distance from the support wall by use of furring strips. The furring strips are first secured to the support wall with the finishing wall secured to the furring strips. In this manner, wallboard, wood panels, and the like can be secured to the support wall at a fixed distance allowing for support wall imperfections. The spacing allows the finishing wall to accommodate imperfections in the support wall as well as provide a spacial insulator.

Wood furring strips are most common as they are simple to install, however, wood provides a base that can warp or be affected by insects. Metal furring strips provide an alternate construction material but are difficult to install and not easily modified without special tools. For instance, if electrical wiring must be transferred between the walls, apertures must be placed in each strip. Even if the apertures in metal are properly cut, sharp edges can be hard to see and may cut electrical wires not sealed in a wire conduit.

Plastic furring strips have been used in an attempt to solve problems inherent in wood and metal furring strips. However, most known plastic structures fail to provide a cost-effective spacer and are simply rectangular shaped furring strips. The plastic furring strips lack the necessary rigidity to maintain the finishing walls in a secure manner by failing to provide a securable surface.

One example of the prior art is U.S. Pat. No. 3,394,507 which discloses a metal structural member for use in supporting wallboards. The wallboard is secured to a first edge of an I-beam, a second wallboard is secured to a second edge of the I-beam. With this device, both sides of the mounted wallboard must be accessible. Sheet metal screws are used for fastening of the wallboards, the screws forming a secure lock to the I-beam.

U.S. Pat. No. 4,041,667 discloses a wall assembly in which finishing wall panels are secured to existing walls by a quick-release fastener such as VELCRO.

U.S. Pat. No. 5,052,164 discloses a structural member for supporting wallboards with a provision for maintaining insulation therebetween.

U.S. Pat. No. 5,092,100 discloses a wall lining structure that allows for spacing of two wallboards and for the support of insulation.

What is lacking in the art is a low cost structural member that allows direct attachment of one wallboard to an existing wall wherein the structural member operates as a spacer with the fastening mechanism reinforcing the rigidity of the structural member.

SUMMARY OF THE INVENTION

The instant invention is an I-shaped extruded plastic structural member having a hollow, centrally-disposed spacer wall, which further provides an alignment bore for positioning of a fastener. The fastener passes through bores pre-formed in first and second support surfaces. The structural member of the instant invention is positionable against an existing wall, such as a cement wall, wherein a "tapcon" or cement-anchoring screw passes through the hollow spacer wall and lodges into the cement. The bores provide quick and accurate alignment of the screw during attachment.

The hollow spacer wall also allows use of cement nails wherein the spacer wall bores align the nail during installation to ensure a consistent attachment. Once the structural member is attached to an existing wall, the wallboard can be attached by adhesive or by use of drywall screws. Placing multiple structural members along twelve or eighteen inch centers simulates the stud or furring mounting of a conventional installation.

The plastic structural members may be modified to accommodate plumbing and electrical wiring by use of through holes positioned along the spacer wall surface. Because the spacer wall is hollow, such through holes can be made by most any hole press, a saw blade, or a knife. The hollow spacer wall allows an individual to use minimum force for creation of the passageways. The double-wall design allows the structure to remain rigid, even though it is perforated.

Thus, an object of the instant invention is to provide an inexpensive structural member which provides a low cost alternative to wood furring strips.

Still another object of the instant invention is to provide a structural member formed from extruded plastic that provides an efficient securement spacer through use of a hollow, thin-walled structure that provides rigidity, yet allows ease of installation and modification.

Yet still another object of the instant invention is to teach the use of a structural member wherein the fastener becomes an integral component of the structural member for making the outer support surface of the structure rigid. The structural member providing alignment for a fasting means to secure the entire width of the member directly to the existing wall, causing the structural member to operate as an alignment tool and spacer device.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
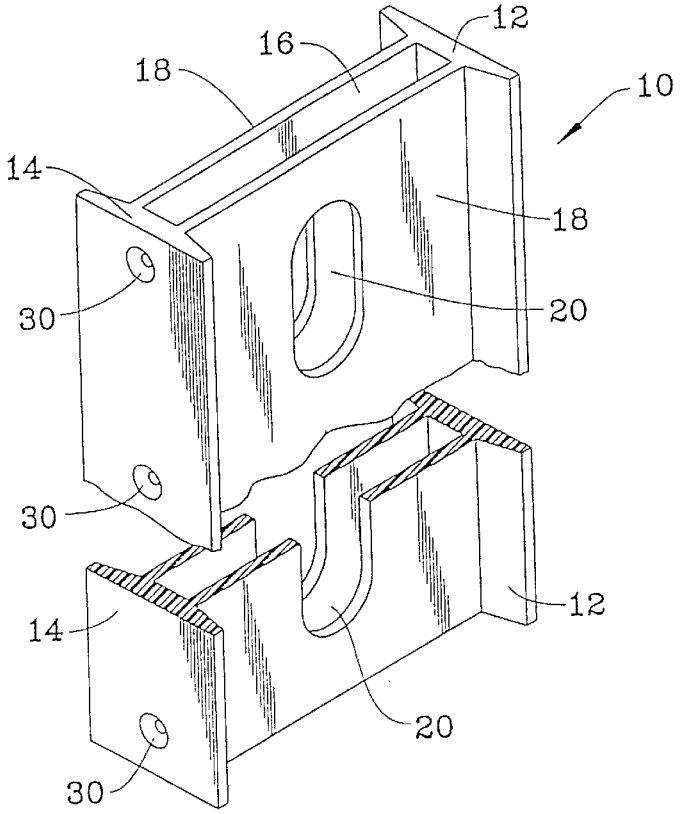
FIG. 1 is a perspective view of the structural member of the present invention.
Figure 2:
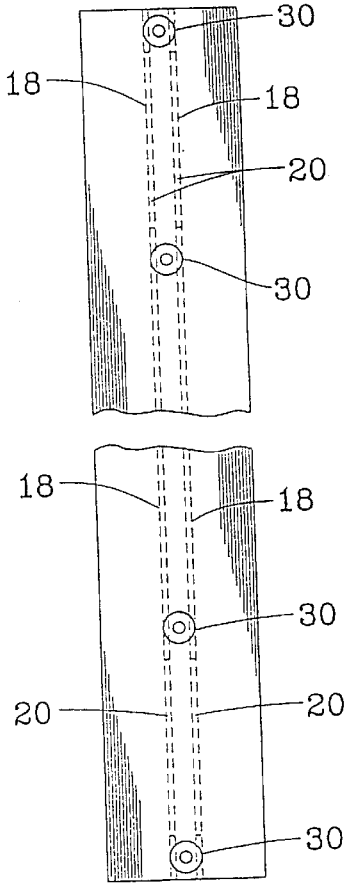
FIG. 2 is a side view of the structural member of the present invention.

Now referring to FIGS. 1 and 2, a structural member 10, according to the present invention is shown. The structural member 10 is an extruded plastic beam that includes a first support surface 12 that is spaced apart from a second support surface 14 by a spacer wall 16 that extends therebetween. The spacer wall 16 is hollow, characterized by a pair of flanges 18 that extend orthogonally between the first and second support surfaces 12, 14. The flanges 18 contain apertures 20 that allow water pipes, electrical or telephone wiring 22, shown in FIG. 4, to pass through the spacer wall 16. The flanges 18 of the spacer wall 16 are spaced apart providing structural rigidity to the member. In this manner each flange wall can be formed from a thin piece of material reducing the weight and material costs of the member. In addition, the hollow area further allowing ease of fastener passage by allowing each side surface to form the alignment mechanism.

Figure 3:
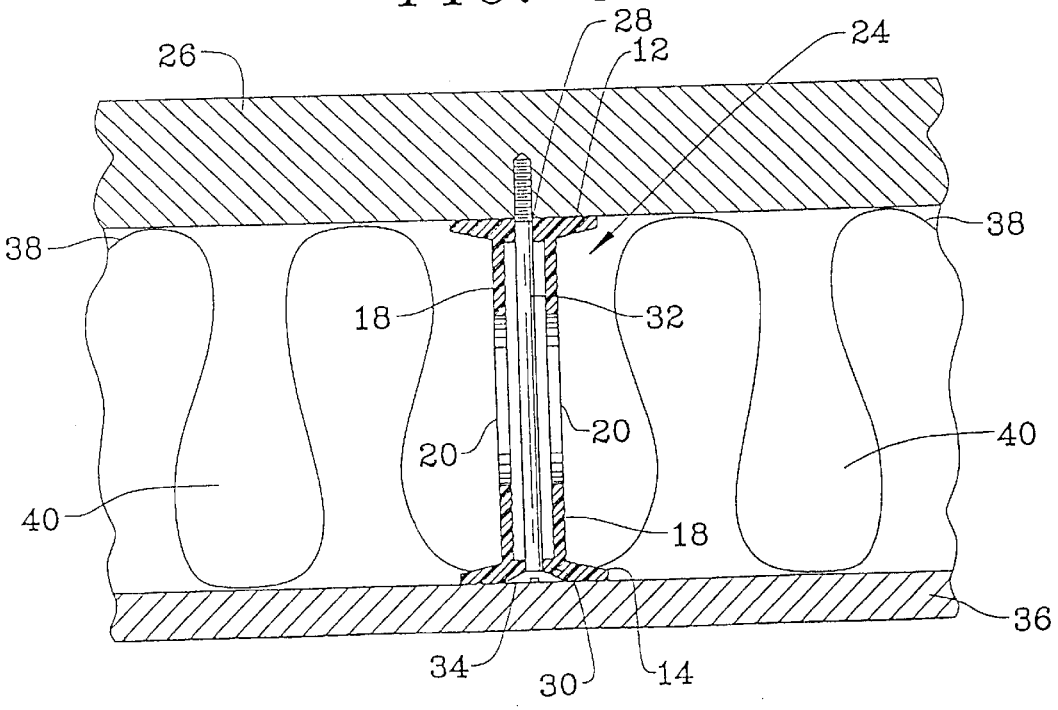
FIG. 3 is an overhead pictorial view of the structural member of the present invention secured between an existing wall and a finishing wall.

With additional reference to FIG. 3, the structural member 10 includes an attachment means 24 that secures the structural member to an existing wall 26. The first support surface 12 includes exit bores 28, and the second support surface 14 includes entry bores. The structural member 10 is held in place against an existing wall 26 by mounting fasteners 32 that are inserted into the entry bores 30. The mounting fasteners 32 pass from the entry bores 30, between the flanges 18, extend through the exit bores 28, and lodge into the existing wall 26. The mounting fastener 32 is typically a bolt or screw. However, other fasteners 23 may be chosen based on the properties of the existing wall 26. The entry bores 30 are counter sunk to allow the head 34 of the mounting fastener 32 to fit flush with the second support surface 14. As used in this application, the term "wall" refers collectively to a group including, but not limited to, vertically-disposed walls, floors, and ceilings. It should be noted that the fastener may pass through the wallboard 36 and the structural member 10 for securement to existing wall 26.

When the structural member 10 is secured against an existing wall 26, sheets of wallboard, or other finishing material 36 are placed against the second support surface 14 and held in place by a suitable joining means (not shown). The preferred joining means is drywall screws passed through the finishing material 36 into the structural member 10. Alternatively, depending on the nature of the finishing material 36 to be attached, the adjoining means may be adhesive or hook-and-loop tape disposed between the second support surface 14 and the finishing material. Slices of rolled insulation 38 may be placed into the chamber 40 formed between the existing wall 26 and the finishing material 36, held in place by the structural member 10.

Figure 4:
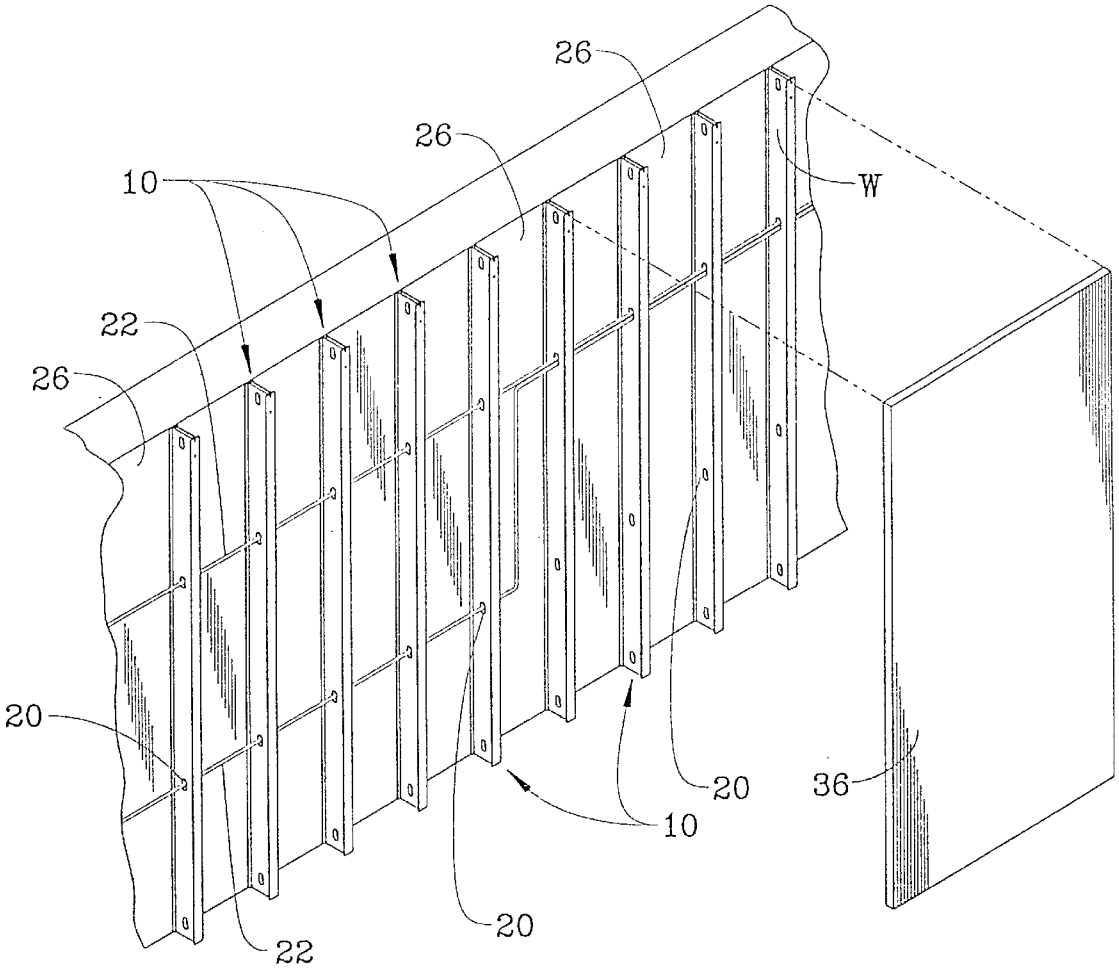
FIG. 4 is a pictorial view of the structural member of the present invention used in series to attach a finishing wall to an existing wall.

FIG. 4 shows the structural member 10 used in series to form a structural frame. Each structural member is attached to an existing wall 26 for support of a wallboard 36 panel. In this fashion, the entire wall of panels is evenly spaced from the existing wall 26 by a distance equal to the width "W" of the structural member 10. This arrangement aligns the apertures 20 so that pipes or wiring 22 pass between the wallboard 36 and the existing wall 26 as needed.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A structural member for securing a new wallboard to an existing wall, said structural member comprising:

a single-piece I-shaped plastic beam having a height and a width, said width defined by a first support surface that is spaced apart from a second support surface by a hollow spacer wall formed integral therebetween;

and an attachment means for securing said second support surface to said wallboard and said first support surface to said existing wall, said attachment means including a mounting fastener adapted to be placed into said existing wall and through said support surfaces, whereby said wallboard may be subsequently secured to said second support surface of said beam.

2. The structural member according to claim 1 wherein said attachment means further includes at least one bore extending through each of said support surfaces for receipt of said mounting fastener.

3. The structural member according to claim 1, wherein said spacer wall includes at least one aperture sized and positioned to accept a pipe having a predetermined diameter.

4. The structural member according to claim 1, wherein said structural member is formed from extruded plastic.

5. A structural member for securing a new wallboard to an existing wall, said structural member comprising:

a single-piece I-shaped plastic beam having a height and a width, said width defined by a first support surface that is spaced apart from a second support surface by a hollow spacer wall formed integral therebetween, said spacer wall being further characterized by at least one aperture disposed therein, said aperture sized and positioned to accept a pipe having a predetermined diameter; and an attachment means for securing said beam to said existing wall, said attachment means including at least one bore extending through each of said support surfaces;

wherein said beam when placed between said existing wall and said new wallboard provides spacing therebetween, and said bore is available for receiving a mounting fastener for securing said wallboard to said existing wall, whereby said wallboard may be subsequently secured to said first support surface of said beam.

6. The structural member according to claim 5, wherein said structural member is formed from extruded plastic.

* * * * *